US006890226B2

(12) United States Patent
Wang

(10) Patent No.: US 6,890,226 B2
(45) Date of Patent: May 10, 2005

(54) ROWING SURF BOARD

(76) Inventor: Ren Hung Wang, No. 161, Si-De Road, Wu-Fuing City, Taichung Hsien (TW)

( * ) Notice: Subject to any disclaimer, the term of this patent is extended or adjusted under 35 U.S.C. 154(b) by 0 days.

(21) Appl. No.: 10/600,458

(22) Filed: Jun. 23, 2003

(65) Prior Publication Data

US 2004/0259438 A1 Dec. 23, 2004

(51) Int. Cl.[7] ..... B63H 1/30
(52) U.S. Cl. ..... 440/17; 440/101
(58) Field of Search ..... 440/13–21, 32, 440/101–104

(56) References Cited

U.S. PATENT DOCUMENTS 3,377,977 A * 4/1968 Malm ..... 440/13
4,043,291 A * 8/1977 Bearup et al. ..... 440/20
5,041,037 A * 8/1991 Jaw ..... 440/102

FOREIGN PATENT DOCUMENTS

DE 3729651 * 3/1989

* cited by examiner

*Primary Examiner*—Ed Swinehart
(74) *Attorney, Agent, or Firm*—Rosenberg, Klein & Lee

(57) ABSTRACT

A rowing surf board includes a board having two through holes defined through the board and tow oars are respectively pivotably engaged with the through holes. Each oar has a blade portion which is pivotably connected to a distal end beneath the board such that the blade portion is pivoted to reduce a contact area against water when the blade portion is moved forward.

7 Claims, 7 Drawing Sheets

ROWING SURF BOARD

FIELD OF THE INVENTION

The present invention relates to rowing surf board which includes two oars pivotably connected thereto and each blade of the oar is pivotable relative to the shank of the oar so as to reduce the resistance when rowing forward.

BACKGROUND OF THE INVENTION

There are many activities such as surfing, kayaking and/or canoeing requires a certain level of skill, wherein the surf board has less amount of volume but it requires skill to keep balance on the wave, the canoe occupies a larger space which is inconvenience for being carried or transported. Operation of a canoe requires rowing two oars and each oar has a blade which is a wider and flat portion such that water can be pushed backward to make the canoe move forward. Nevertheless, when the oars are rowed forward, the wide blade portion generates a resistance which makes the user feel tired within a short period of time. A good canoeist rotates the blade portions during the oars being moved forward to reduce the area against the water. This is not an easy job for ordinary canoeists.

The present invention intends to provide a rowing surf board which has two oars pivotably connected to the surf board and the blade portion of each oar is pivotable when the oars are moved forward so that the players are suffered less resistance.

SUMMARY OF THE INVENTION

In accordance with one aspect of the present invention, there is provided a rowing surf board which comprises a board having two through holes defined through two sides of the board. An oar extends through each of the through holes and is pivotably engaged with the board at the through hole. Each oar has a blade portion pivotably connected thereto such that the blade portion is pivoted to reduce a contact area against water when the blade portion is moved forward.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
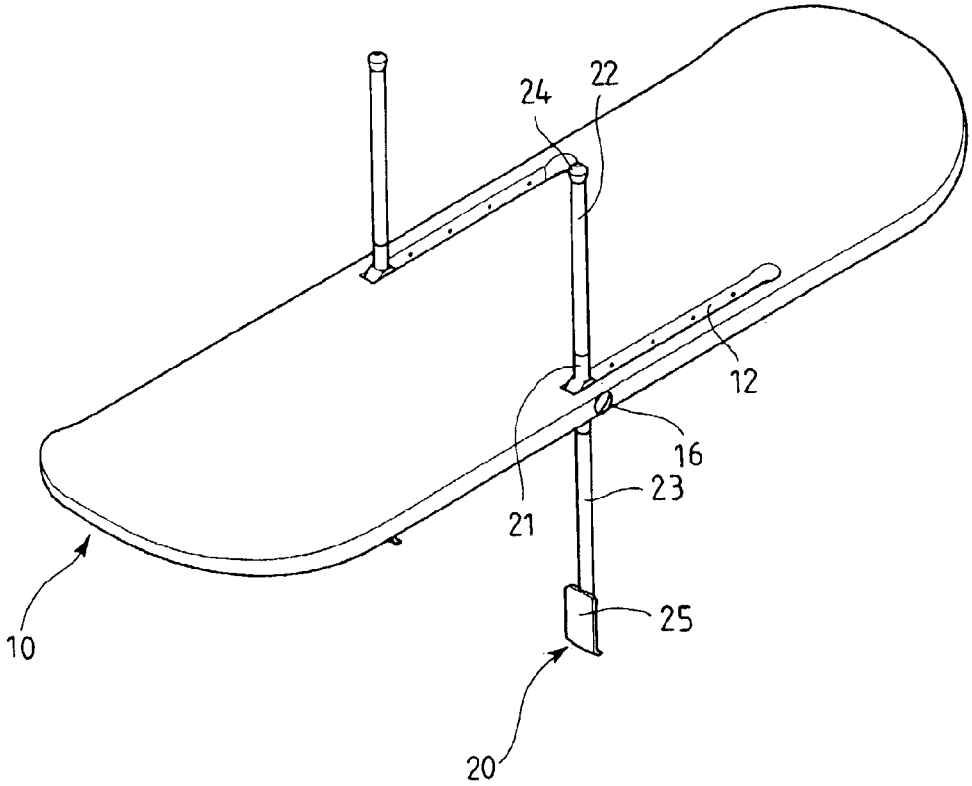
FIG. 1 is a perspective view to show the rowing surf board of the present invention.
Figure 2:
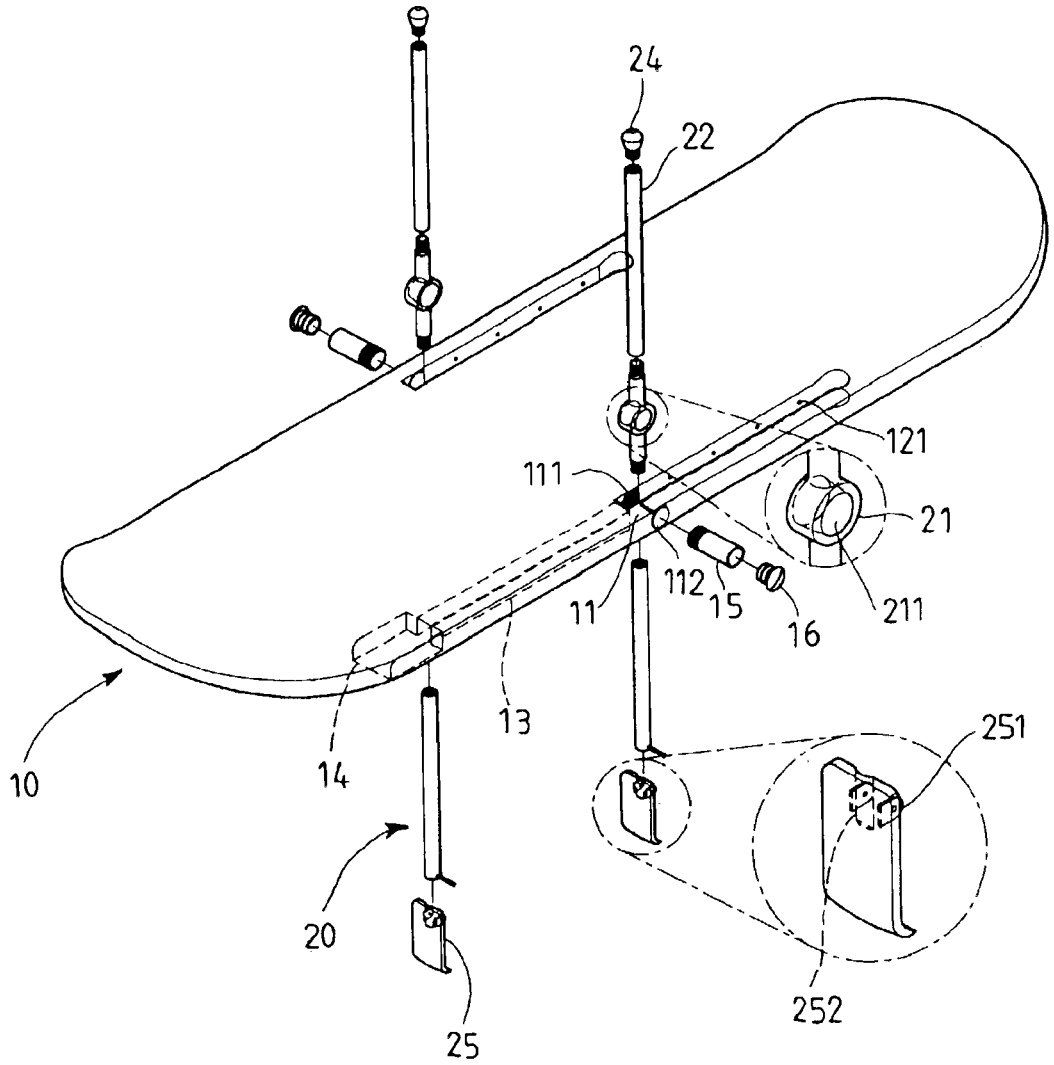
FIG. 2 is an exploded view to show the rowing surf board of the present invention.
Figure 4:
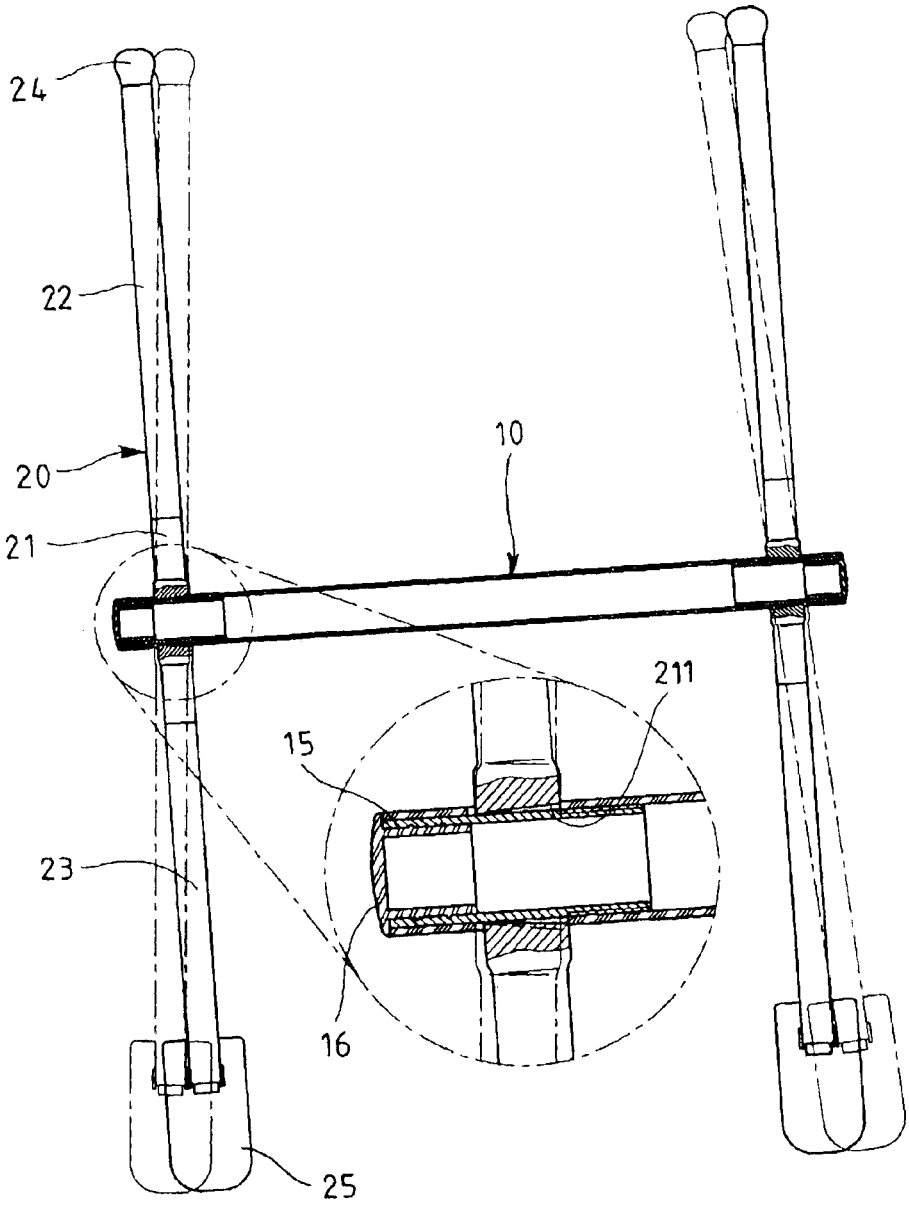
FIG. 4 shows that each connection portion has a tapered passage so that the oar can be tilted an angle.

Referring to FIGS. 1 and 2, the rowing surf board of the present invention comprises a board 10 which is made of foam material and covered by plastic. The board 10 has two through holes 11 defined through the board 10 and located at two sides of the board 10. Two first slots 12 are defined in a top of the board 10 and communicate with the two through holes 11 respectively. Two second slots 13 are defined in an underside of the board 10 and communicate with the two through holes 11 respectively. The first slot 12 and the second slot 13 are located in opposite with each other and share a common axis An oar 20 extend through each of the through holes 11 and pivotably engaged with the board 10 at the through hole 11. Each of the oars 20 includes a connection portion 21, a first section 22 and a second section 23. The connection portion 21 includes a tapered passage 211 defined transversely therethrough and a pin 15 extends through a hole in each side of the board 10, the passage 211 and is threadedly engaged with a threaded hole 111 in the board 10. An end piece 16 is used to seal an open end of each of the pins 15. The first section 22 is connected to the connection portion 21 and located above the board 10. An end piece 24 is connected to a distal end of the first section 22. The second section 23 is connected to the connection portion 21 and located below the board 10. The blade portion 25 is pivotably connected to the second section 23. The tapered passage 211 allows the oar 20 to tilt an angle during operation as shown in FIG. 4.

Each oar 20 has a blade portion 25 which is pivotably connected thereto. Each of the blade portions 25 has two lugs 251 extending from a side thereof and the second section 23 is pivotably connected to the two lugs 251. Each of the blade portions 25 has a recessed portion 252 defined between the two lugs 251 and the second section 23 is removably engaged with the recessed portion 252.

Figure 6:
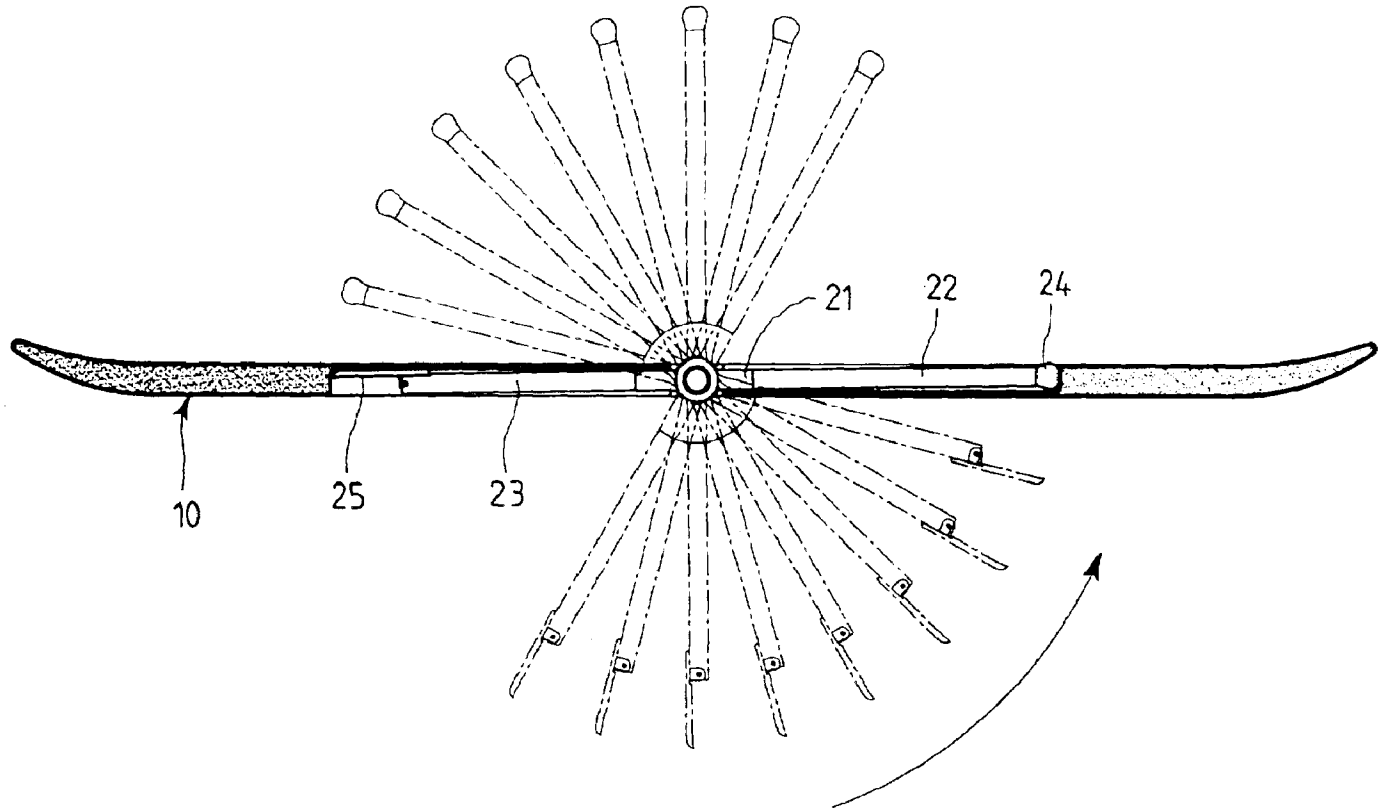
FIG. 6 shows that the blade portion is operated to pull water backward.
Figure 7:
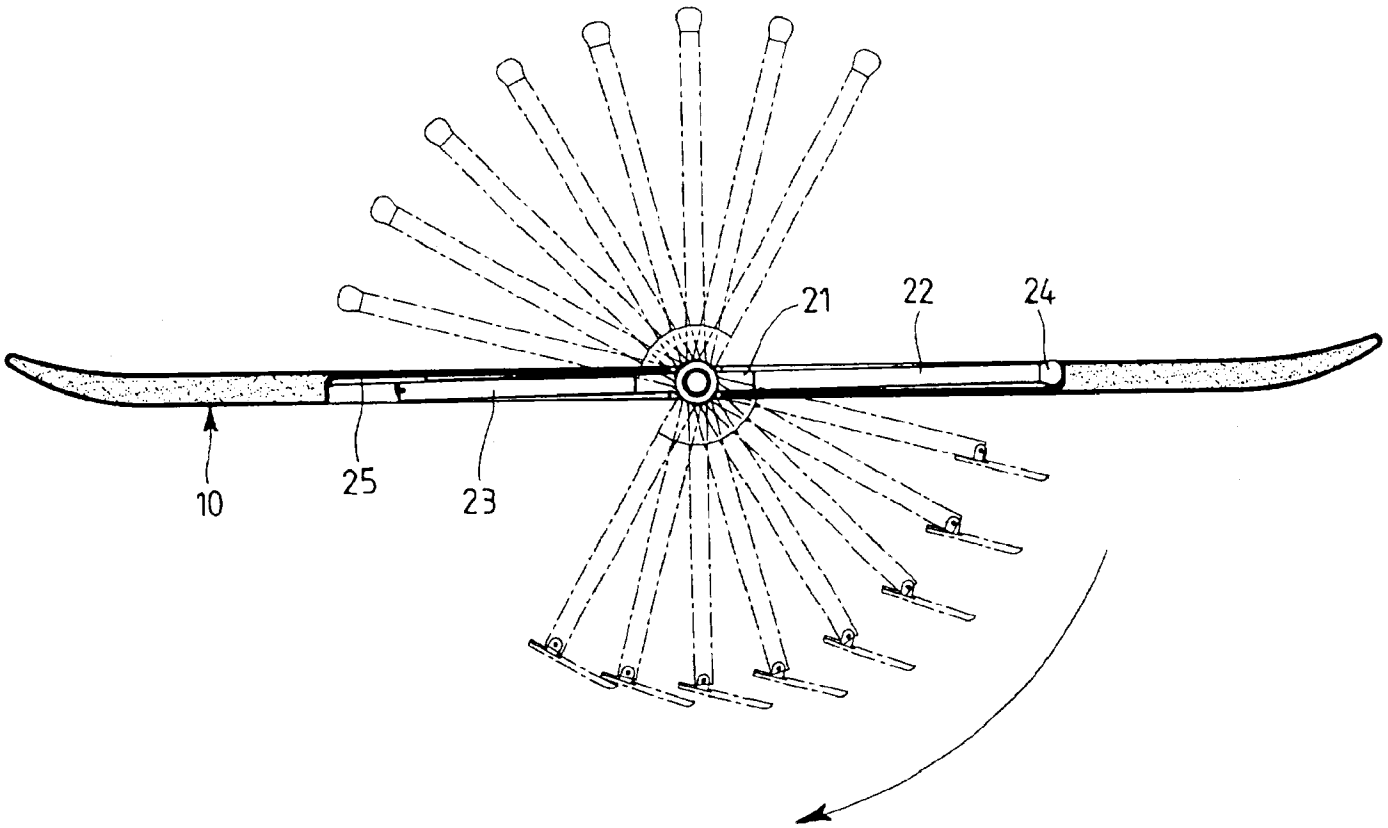
FIG. 7 shows that the blade portion is pivoted an angel when the oar is moved forward.

As shown in FIG. 6, when the oars 20 are rowed backward, the blade portions 25 are pushed by the water by their maximum area. As shown in FIG. 7, when the oars 20 are rowed frontward, the blade portions 25 are pivoted an angle by the water so that a less contact area is used to against the water and this reduces the water resistance.

Figure 3:
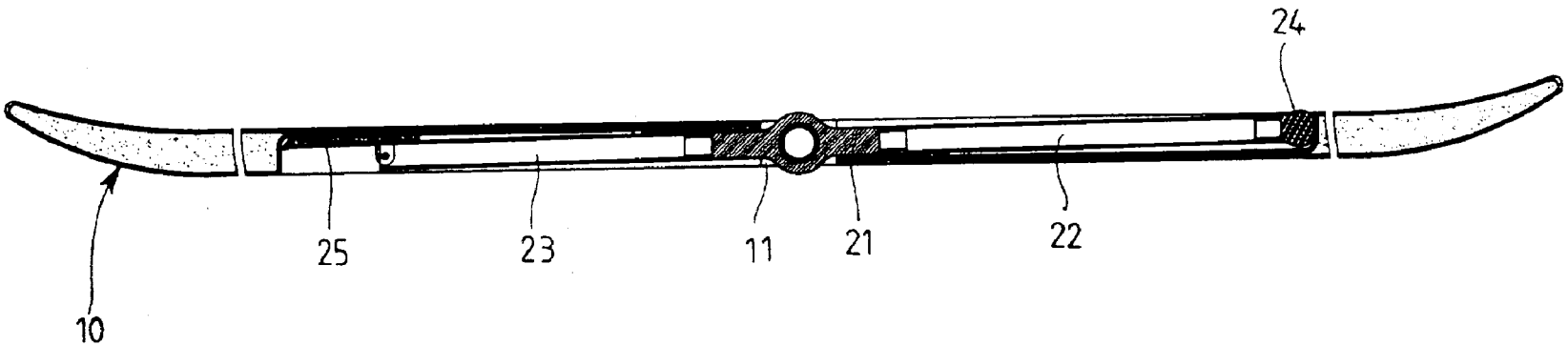
FIG. 3 shows the oar is received in the first slot and the second slot.
Figure 5:
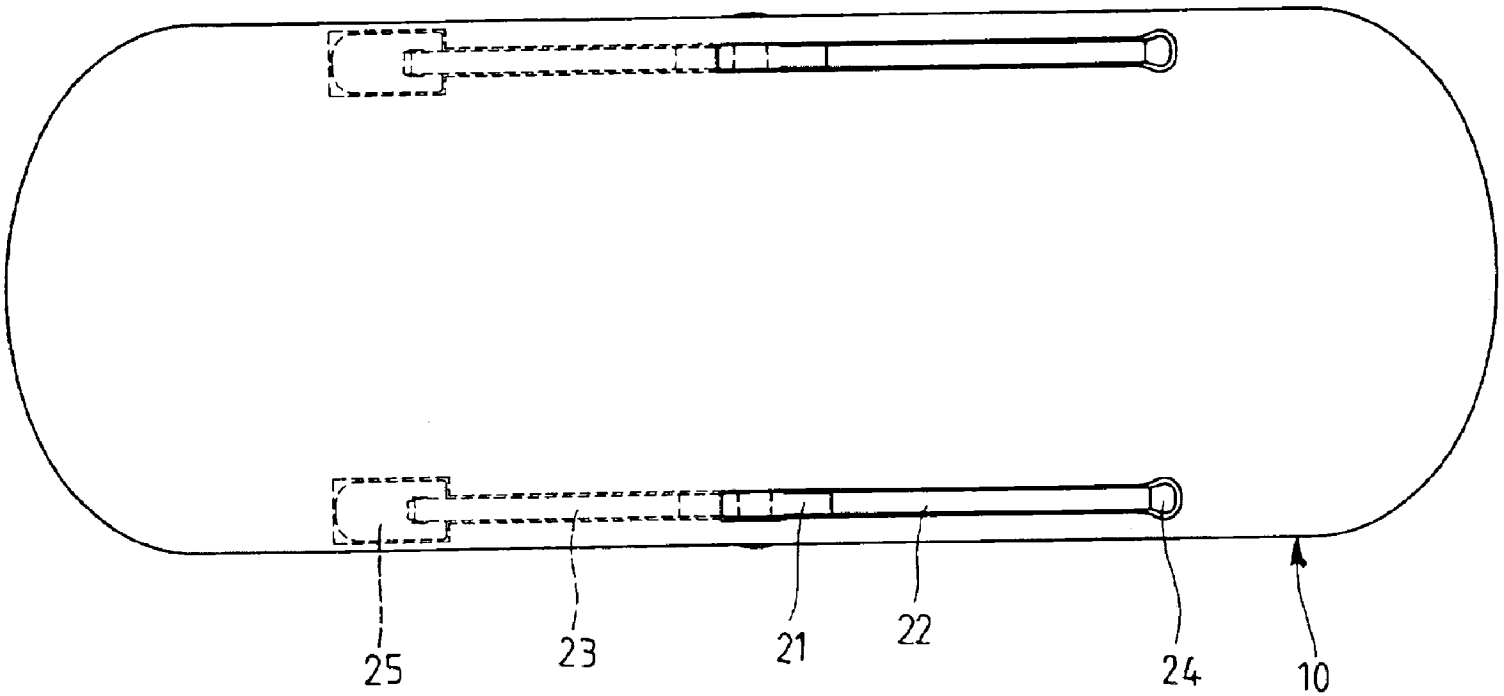
FIG. 5 is a top view to show that the oar is received in the first slot and the second slot.

As shown in FIGS. 3 and 5, the first section 22 and the second section 23 can be received in the first slot 12 and the second slot 13 respectively when not in use. A plurality of bosses 121 extend from an inside of each of the first slots 12 so as to easily position the first sections 22 of the oars 20.

The board 10 can be used as a surf board when the oars 20 are positioned in the slots 12, 13, and can be used as a kayak by rowing the two oars 20.

While we have shown and described the embodiment in accordance with the present invention, it should be clear to those skilled in the art that further embodiments may be made without departing from the scope of the present invention.

What is claimed is:

1. A rowing surf board comprising:

a board having two through holes defined through the board and located at two sides of the board, an oar extending through each of the through holes and pivotably engaged with the board at the through hole, each oar having a blade portion which is pivotably connected thereto such that the blade portion is pivoted to reduce a contact area against water when the blade portion is moved forward;

the board having at least a pair of slots formed in an underside thereof, each blade portion being retractable to a fully recessed position within one of the slots.

2. The rowing surf board as claimed in claim 1, wherein two first slots are defined in a top of the board and communicate with the two through holes respectively, the slots defined in the underside of the board being second slots communicating with the two through holes respectively, each first slot sharing a common axis with one of the second slots so that each of the oars is received concurrently therein.

3. The rowing surf board as claimed in claim 1, wherein a plurality of bosses extend from an inside of each of the first slots.

4. The rowing surf board as claimed in claim 1, wherein each of the oars includes a connection portion, a first section and a second section, the connection portion including a passage defined transversely therethrough and a pin extending through the passage and fixedly connected to the board, the first section connected to the connection portion and located above the board, the second section connected to the connection portion and located below the board, the blade portion pivotably connected to the second section.

5. The rowing surf board as claimed in claim 4, wherein each of the blade portions has two lugs extending from a side thereof and the second section is pivotably connected to the two lugs.

6. The rowing surf board as claimed in claim 5, wherein each of the blade portions has a recessed portion defined between the two lugs and the second section is removably engaged with the recessed portion.

7. A rowing surf board comprising:

a board having two through holes defined through the board and located at two sides of the board, an oar extending through each of the through holes and pivotably engaged with the board at the through hole, each oar having a blade portion which is pivotably connected thereto such that the blade portion is pivoted to reduce a contact area against water when the blade portion is moved forward;

wherein each passage in the connection portions is a tapered passage so that the oars are tilted at an angle during operation.

* * * * *